United States Patent [19]

Jaggard et al.

[11] 4,003,393

[45] Jan. 18, 1977

[54] GEL-LIKE COMPOSITION FOR USE AS A PIG IN A PIPELINE

[75] Inventors: William Jaggard; Allen A. Scales, both of Calgary, Canada

[73] Assignee: The Dow Chemical Company, Midland, Mich.

[22] Filed: Feb. 14, 1973

[21] Appl. No.: 332,324

[52] U.S. Cl. ..... 137/15; 15/104.06 R; 134/22 C; 137/1

[51] Int. Cl.[2] ..... B08B 9/04

[58] Field of Search ..... 15/104.06 R; 134/22 C; 137/1, 15, 240

[56] References Cited

UNITED STATES PATENTS

| | | | |
|---|---|---|---|
| 2,983,678 | 5/1961 | Pellegrini et al. | 252/32.5 |
| 3,010,853 | 11/1961 | Elliott | 134/22 C X |
| 3,209,771 | 10/1965 | Gogarty et al. | 137/1 |
| 3,494,949 | 2/1970 | Monroe et al. | 260/448 R |
| 3,505,374 | 4/1970 | Monroe | 260/439 R |
| 3,631,870 | 1/1972 | Livingston | 137/1 X |
| 3,757,864 | 9/1973 | Crawford et al. | 137/13 X |

*Primary Examiner*—Alan Cohan
*Assistant Examiner*—Gerald A. Michalsky
*Attorney, Agent, or Firm*—Bruce M. Kanuch

[57] ABSTRACT

A gel-like mass is prepared comprising a highly gelled organic liquid which can be fluidized after its intended use. A hydrocarbon liquid is gelled with a metal salt of an aliphatic substituted orthophosphate ester to form a substantially self-sustaining gel-like mass (slug or pig) when flowing under pressure through a pipeline. The pig may be employed as an interfacial control for different fluids flowing in the same pipeline, and also to remove residual fluids and/or solids from a pipeline.

5 Claims, No Drawings

GEL-LIKE COMPOSITION FOR USE AS A PIG IN A PIPELINE

BACKGROUND OF THE INVENTION

U.S. Pat. No. 3,209,771 teaches the use of gelled bodies for separating two fluids flowing in a pipeline. In U.S. Pat. No. 3,225,787 an attempt is made to improve the technique of U.S. Pat. No. 3,209,771 by employing an elongated gel filled pipeline pig having elastic reinforced rubber sidewalls and thickened ends. The latter technique was employed to overcome the problem of the gelled body of U.S. Pat. No. 3,209,771 breaking down in long pipelines. However, while solving this problem several new problems ensued. First, due to the thick walls of the pig taught in U.S. Pat. No. 3,225,787 the pig lost some of its flexibility and tended to be blocked by "stalactites" located at welded joints in the line. Further, the pig could only be employed in one size pipeline. Canadian Patent No. 903,621 teaches to overcome the blocking problem by employing an elongated gel-filled pipeline pig having thin lateral walls and elastic end walls. The walls are sufficiently thin so that they are ripped by stalactites and flow on without substantial pressure build-up.

An ideal pipeline pig would be a gelled self-sustaining mass which does not break up in line pipelines and which can be readily converted to a liquid for disposal at the end of the flow cycle. Furthermore, it would be preferable if the pig could change size so that it could flow through different size conduits. The present invention concerns a gel-like mass which does not break up in long pipelines and which can readily be returned to a liquid form at the end of the use cycle. In addition the pig can be flowed directly from one size pipe to another. Also, the gelled pig can be employed as a wiper plug to remove various fluids (e.g. hydrocarbons, asphaltines, paraffins), solids and semi-solids such as sand, tar, corrosion products and the like from conduits. The gel of the present invention not only wipes surfaces clean but can absorb a substantial amount of water without breaking down.

SUMMARY OF THE INVENTION

A gel-like mass is prepared by mixing an organic liquid with a sufficient quantity of a gelling agent comprising a metal salt of an aliphatic substituted orthophosphate ester to form a self-sustaining gel-like mass. The pig can be employed to separate fluids flowing in a conduit by introducing the gel into a pipeline between flowing fluids. The gelled mass moves with and separates the fluids under normal pumping pressures. The gelled mass can also be employed to clean, i.e., to remove various fluids and solids from pipelines by introducing a sufficient quantity of the gelled mass into the pipeline and moving it therethrough with a driving fluid such as a liquid hydrocarbon, natural gas, $CO_2$, nitrogen, air or the like. Thus, it can be employed in conjunction with clean up, corrosion inhibiting or other similar techniques wherein various liquids and/or solids must be removed from conduits such as gas, oil and water pipelines and the like.

DETAILED DESCRIPTION OF THE INVENTION

The gel-like mass employed in the invention is prepared by gelling an organic liquid with a gelling quantity of a metal salt of an aliphatic substituted orthophosphate ester. Salts which can be employed include, for example, those metal salts of aliphatic substituted esters taught in U.S. Pat. Nos. 2,983,678; 3,494,949 and 3,505,374. These esters are taught to be useful viscosity improving agents, gelling agents, thickeners, and the like, for various organic liquids. The teachings of these patents are specifically incorporated herein by reference. Aluminum, iron, chromium, zirconium, titanium, tin, mercury and rare earth metal salts of aliphatic substituted orthophosphate esters can be employed in the practice of the present invention.

The aluminum aliphatic orthophosphate esters are preferred gelling agents for organic or oil-base liquids employed in the practice of the invention.

The aliphatic groups of the ester are preferably selected from, for example, methyl, ethyl, propyl, isopropyl, isobutyl, t-butyl, butyl, amyl, hexyl, octyl (caprylyl), nonyl, decyl, dodecyl (aluryl), tridecyl tetradecyl (myristryl), pentadecyl, hexadecyl, heptadecyl, octadecyl (stearyl), nonadecyl, eicosyl, and various combinations of straight and branched chain alkyls within the same molecule and mixtures of various straight and branched chain dialkyls. They also include the corresponding unsaturated straight and branched chain aliphatics, viz., alkenyls and alkynyls. Compounds corresponding to the formula

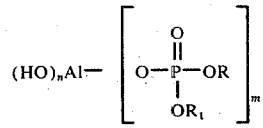

wherein n = 2 to 0, m = 1 to 3, and n + m is equal to 3, and wherein R and $R_1$ are independently $C_1$ to $C_{20}$ alkyls or $C_3$ to $C_{20}$ alkynyls or alkenyls can be employed. Also, R or $R_1$, but not both, may be H. The aluminum salt of any combination of these esters may be employed as the gelling agent for the organic or oil-base liquid. When n is zero, the orthophosphate group integer "m" is 3 and when n is 2, m is 1. Any arithmetical value above zero but not more than 3 is an average and may be 1.25 to 2.4 or the like for the orthophosphate group. Specific salts, illustrative only, of the type which can be used in the practice of the invention, are: aluminum salt of methyl tetradecylorthophosphoric acid ester, aluminum salt of methyldodecylorthophosphoric acid ester, aluminum salt of ethyldodecylorthophosphoric acid ester, aluminum salt of alkenyloctylorthophosphoric acid ester, or aluminum salt of propynyldecynylorthophosphoric acid ester. For ease of expression, the aliphatic-substituted aluminum orthophosphate may often be referred to merely as the alkyl ester or salt, although it is understood that the unsaturated hydrocarbon radicals are included.

The aluminum salt of aliphatic orthophosphate ester can be prepared by any suitable procedure known in the art. One such procedure is described in *Industrial and Engineering Chemistry*, Vol. 34, page 20 et seq (1942); *Chemical Industries*, Vol. 4, page 516 et seq (1942); U.S. Pat. No. 3,494,949 and the like.

The procedure for preparing the alkyl esters generally requires reacting an orthophosphoric acid ester (e.g., prepared by reacting a selected alcohol or mixture of alcohols with a phosphorus compound such as phosphorus pentoxide, phosphorus oxychloride, $PCl_5$, $PF_5$, etc.) with a basic metal compound. Suitable basic aluminum compounds include, for example, sodium aluminate, alumnum isopropoxide, hydrated alumina or the like. Other metal compounds include, for example, magnetite, basic chromium chlorides, basic iron chlorides and the like.

The metal salt of the orthophosphate ester, e.g., an aluminum salt, as described above, may be admixed with the organic liquid in any convenient manner. For example, the additament at either full strength, or more usually diluted by kerosene or the like, may be admixed in a storage vessel prior to its introduction into tubing, pipelines, or the like.

The recommended procedure to follow in preparing the pig to be employed in practicing the invention is to gel an organic liquid with from about 20 to 500 pounds by weight of a metal, preferably aluminum, alkyl- or alkenylorthophosphate per 1000 gallons of the liquid, e.g., gasoline, oil, diesel oil, crude oil, kerosene or the like. An amount of the ester which is sufficient to prepare a gelled organic liquid having a sufficient gelled structure to form an essentially self-sustaining mass in the pipeline or other conduit is employed.

It has been found that maximum gel strength depends not only upon the amount of metal salt present but when an organic liquid is gelled by separately adding an aluminum compound and an ester to the liquid, also upon the weight ratio of the reactants. The preferred ratio for any given reactants can be readily determined by simple laboratory procedures wherein the total amount used and the ratio of the specific reactants are varied until a specific viscosity or maximum viscosity is achieved in a specific organic liquid. Generally, it is preferred to have a viscosity which is greater than that of the other fluids in the pipeline.

Organic liquids which can be employed are generally non-polar and include, for example, aliphatic and aromatic hydrocarbons, and mixtures thereof, refined paraffinic oils, e.g., condensates from gas wells, lubricating oils, kerosene, diesel oils, some crude oils, mixtures of these and the like. The effectiveness of any particular metal salt in any specific organic liquid should be determined prior to a large scale operation.

If desired, the viscosity of the gelled pig may be automatically reduced (i.e., broken) by the addition of an appropriate gel breaker which functions slowly to break the gel in, for example, from 4–48 hours. Suitable gel breakers include, for example, certain aliphatic amines and the like.

In practicing the invention, usual pumping equipment and the general layout conventionally employed, other than the admixture of the selected metal aliphatic orthophosphate ester, may be employed to displace the gelled mass into and through a conduit, e.g. pipeline. A liquid, e.g. water or another fluid, and/or solids, can be displaced from a section of pipeline by moving the gel-like mass (pig), preferably by a driving fluid, e.g. oil, behind the gelled pig, through the conduit, e.g. casing or tubing pipelines, under a pumping pressure which forms the gel-like mass into a self-sustaining body having its peripheral surfaces contiguous with the inner surfaces of the conduit and its ends contiguous with the fluids and/or solids in the conduit. As previously indicated the gelled pig of the present invention operates exceptionally well to remove water or moisture from a pipeline, e.g. gas line, because the gelled pig not only operates to wipe the surface but also absorbs moisture therefrom thereby providing a very dry pipeline.

Particular gelling agents which can be employed in the invention can be prepared as follows:

Preparation of methyldodecylorthophosphoric acid ester:

The equipment consists of a 2-liter round-bottom flask equipped with a mechanical stirrer, reflux condenser, dropping funnel and thermometer.

A total of 400 milliliters of dry hexane is placed in the 2-liter flask, then 142 grams (1 mole) of $P_2O_5$ are added and stirred to form a slurry.

Three hundred seventy-two grams (2 moles) of dodecyl alcohol and 64 grams (2 moles) of methyl alcohol are mixed together and added via dropping funnel to the hexane and $P_2O_5$ slurry with rapid stirring. Cooling is required to keep the reaction temperature below 40° C.

After the alcohols have been added, the reaction mixture is heated to and maintained at a temperature such that the hexane will reflux for one hour.

The hexane is thereafter removed by distillation, the last traces being removed under a reduced pressure reading of 100 millimeters mercury.

A method for the preparation of aluminum salt of methyldodecylorthophosphoric acid ester comprises:

Admixing in a 2-liter flask equipped with a mechanical stirrer and thermometer 700 milliliters of water and 200 milliliters ethanol. NaOH (19.8 grams), dissolved in 100 milliliters of water, are added to the water and ethanol mixture. Methyldodecylorthophosphoric acid ester (140 grams) are added and mixed well. A solution of 82 grams of $Al_2(SO_4)_3.18H_2O$, dissolved in 100 milliliters water, is added accompanied by rapid agitation. The finely dispersed precipitate is thereafter filtered and washed with water. The filtered and washed precipitate is dried under mild temperature under at least a partial vacuum.

A method for the preparation of ethyltetradecylorthophosphoric acid ester comprises admixing 90 milliliters of ethyl alcohol and 332 grams of tetradecyl alcohol in a 1-liter flask equipped with a mechanical stirrer and thermometer. The alcohols are heated while stirred to approximately 50° C to melt the tetradecyl alcohol. The alcohols are then mixed together.

Very slowly and cautiously 110 grams of dry phosphorus pentoxide ($P_2O_5$) are added directly to the mixture of alcohols contained in the flask. Stirring is maintained at a rate adequate to disperse, with a minimum delay, the $P_2O_5$ into the alcohols. Cooling may be necessary. Temperature should not be allowed to exceed 80° C. After all the $P_2O_5$ has been added, the materials in the flask are heated, if necessary, to 80° and held thereat for 1 hour.

This reaction product may be diluted with 50–5000 ml fluid hydrocarbon and activated by admixing 1.05 grams of sodium aluminate (38% in aqueous solution).

EXAMPLE 1

It was desired to inhibit and remove as much water as possible from an 8 inch gas flow line which was not to be used for a period of years. Approximately 1500 gallons of condensate (lighter liquid hydrocarbons condensing from a gas well having a boiling point ranging from about 80°–150° F) was gelled according to the practice of the present invention. To 1500 gallons of the condensate was added 30 gallons of an aqueous solution containing the reaction product of 60 pounds of phosphorus pentoxide, 60.8 pounds of dodecanol;

59 pounds of a mixture of 45.1 per cent by weight n-octanol; 54.5 per cent by weight n-decanol; 0.4 per cent by weight of n-hexanol and 34.1 pounds of ethyl alcohol. To this mixture was added 5.1 gallons of a sodium aluminate solution containing about 38.2 per cent by weight of active sodium aluminate. A gel resulted having a viscosity of about 1200 centipoise. The 1500 gallons of gelled condensate was pumped into the pipeline to be cleaned through a 2 inch line to form a pig in the line. Following the injection of the 1500 gallons of the gelled condensate, 5 barrels of ungelled condensate followed by 31 barrels of inhibited condensate containing a known corrosion inhibitor were pumped into and in contact with the gelled pig. A total of 143.5 barrels of alcohol and inhibited condensate were pumped through about 10,000 feet of the pipeline and recovered therefrom. The gelled condensate was still essentially in a uniform self-sustaining mass and there was little evidence of intermixing between the gel and the hydrocrbon driving fluids. The pipeline was inspected following the treatment and no water was detected. Previous attempts to remove water from low spots by pumping ungelled condensates through the pipeline were unsuccessful.

EXAMPLE 2

It was desired to inhibit corrosion and remove a build-up of solids in the low lying sections of a gas pipeline. This build-up was essentially made up of hydrocarbon type material (asphaltine, tar, solids). Approximately 500 gallons of xylene were injected into the natural gas strem flowing in the pipeline at 1 BPM (approximately 4000 SCF/gas/barrel of xylene). The pipeline was shut in for 24 hours to allow the xylene to drop out of the gas and dissolve the build-up of hydrocarbon material. Approximately 4,000 gallons of condensate were gelled according to the practice of the present invention by adding to the 4,000 gallons of condensate 80 gallons of the reaction product described in Example 1, and 12 gallons of the sodium aluminate solution. A gel resulted having a viscosity of about 1,200 centipoise. Two thousand (2,000) gallons of the gelled condensate were pumped into the pipeline to be cleaned through a 2 inch line. Following the injection of 2,000 gallons of gelled condensate, 24 barrels of the condensate containing a known corrosion inhibitor were pumped into the pipeline. This was followed by an additional 2,000 gallons of gelled condensate and displaced with natural gas through approximately 58,000 feet of 6 inch pipeline and recovered therefrom. The gelled condensate was still essentially in a uniform self-sustaining mass and there was little evidence of intermixing between the gel and the hydrocarbon fluid and driving gas. The pipeline was inspected by X-ray after the treatment with no sign of hydrocarbon or solids build-up.

Other solvents, e.g. aromatic liquids such as benzene, toluene, etc., can be employed to remove hydrocarbon build-up by the procedure described in this example. In addition scale solvents and other cleaning materials can be employed when the situation dictates.

EXAMPLE 3

An unique application of the gelled pig of the present invention is the versatility to change size to conform to different size pipelines (going from 6 inch pipeline into an 8–10 inch or larger pipeline). In a cleanup job similar to that disclosed in the previous examples a condensate gelled according to the practice of the present invention was flowed through a gas line which was made up of approximately 6 miles of 6 inch line and 4 miles of 10 inch line. There was no indication of aqueous hydrocarbon fluids or solids remaining in the line after cleaning indicating that the gel conformed to the walls of both the 10 and 6 inch lines.

What is claimed is:

1. A method of removing residual fluids and solids from a pipeline which comprises:

a. as an initial step treating the inner surface of the pipeline to remove solid and semi-solid deposits therefrom;

b. introducing into said pipeline a gel-like mass composed of an organic liquid which is gelled with a gelling quantity of a metal salt of an aliphatic substituted orthophosphate ester, and c. moving said gel-like mass through said pipeline under pumping pressure which forms said gel-like mass into a self-sustaining body having its peripheral surfaces contiguous with the inner surfaces of the pipeline to remove residual liquids and solids therefrom.

2. A method of removing residual fluids and/or solids from a pipeline which comprises:

a. introducing into said pipeline a gel-like mass composed of an organic liquid which is gelled with a gelling quantity of a metal salt of an aliphatic substituted orthophosphate ester and which includes, in addition, a substance which functions to break said gel after a period of time to form a readily flowable mass, and b. moving said gel-like mass through said pipeline under pumping pressure which forms said gel-like mass into a self-sustaining body having its peripheral surfaces contiguous with the inner surfaces of the pipeline to remove residual liquids and solids therefrom.

3. A method of removing residual fluids and hydrocarbon solids from a pipeline which comprises:

a. introducing into said pipeline a solvent for solid hydrocarbon residuals and shutting in the pipeline for a period of time sufficient on the inner surface of said pipeline;

b. introducing into said pipeline a gel-like mass composed of an organic liquid which is gelled with a gelling quantity of a metal salt of an aliphatic substituted orthophosphate ester, and c. moving said gel-like mass through said pipeline under pumping pressure which forms said gel-like mass into a self-sustaining body having its peripheral surfaces contiguous with the inner surfaces of the pipeline to remove residual liquids and solids therefrom.

4. The method of claim 3 wherein the solvent is xylene, benzene or toluene.

5. The method of claim 4 wherein said solvent is injected into a gas stream flowing in the pipeline.

* * * * *

UNITED STATES PATENT OFFICE

CERTIFICATE OF CORRECTION

PATENT NO. : 4,003,393

DATED : Jan. 18, 1977

INVENTOR(S) : William Jaggard; Allen A. Scales

It is certified that error appears in the above-identified patent and that said Letters Patent are hereby corrected as shown below:

Col. 1, line 27, change "line" to --long--;
Col. 2, line 17, between "tridecyl" and "tetradecyl" insert --,--;
Col. 3, line 2, correct spelling from "alumnum" to --aluminum--;
Col. 5, line 21, correct spelling from "hydrocrbon" to --hydrocarbon--;
line 34, correct spelling from "strem" to --stream--;

Col. 6, line 50, after "sufficient" insert --for said solvent to dissolve hydrocarbon residuals--.

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*